United States Patent [19]

Pintsak et al.

[11] 4,149,636

[45] Apr. 17, 1979

[54] CARRIER FOR CYLINDRICAL ARTICLES

[75] Inventors: William P. Pintsak, Twinsburg; Harry N. Parker, Toledo, both of Ohio

[73] Assignee: Container Corporation of America, Chicago, Ill.

[21] Appl. No.: 907,821

[22] Filed: May 19, 1978

[51] Int. Cl.[2] ..... B65D 65/24; B65D 75/52

[52] U.S. Cl. ..... 206/434; 229/40

[58] Field of Search ..... 206/426, 433, 434, 435, 206/431, 427, 193, 197, 199, 139; 229/28 R, 40

[56] References Cited

U.S. PATENT DOCUMENTS

| | | | |
|---|---|---|---|
| 3,598,302 | 8/1971 | Nowak | 206/197 |
| 3,836,066 | 9/1974 | Del Priore et al. | 229/40 |
| 3,854,580 | 12/1974 | Hennessey | 206/426 |
| 3,931,888 | 1/1976 | Fogel | 206/434 |
| 4,037,721 | 7/1977 | Schillinger | 206/426 |

*Primary Examiner*—Herbert F. Ross

*Attorney, Agent, or Firm*—Carpenter & Ostis

[57] ABSTRACT

A carrier for glass tumblers, or the like, is formed from paperboard and comprises a sleeve. Locking flaps are folded inwardly from the ends of the sleeve. The flaps are formed with openings bridged by straps having tabs formed thereon providing angular relationship between the locking flaps and the walls of the carrier.

3 Claims, 5 Drawing Figures

CARRIER FOR CYLINDRICAL ARTICLES

BACKGROUND OF THE INVENTION

1. Field of the Invention.

This invention relates to carrier cartons and, more particularly to carrier cartons for packaging of cylindrical articles, such as glass tumblers.

2. The Prior Art.

The prior art relating to the subject matter of the present invention is best exemplified by U.S. Letters Pat. No. 3,598,302 to William W. Nowak (Class 229/28R). The present invention eliminates the central support panel of Nowak and improves article retaining characteristics of the carrier. The present carrier has a strap bridging each of the article retaining openings in the locking flaps to provide positive means preventing collapse of the locking flaps and to improve the angular relationship between the flaps and the walls of the carrier thus eliminating malfunctioning of the flaps. The present construction securely retains the articles in the carrier.

SUMMARY OF THE INVENTION

Generally, a sleeve type carrier carton is formed with article locking flaps which are folded with respect to the carrier. The flaps have angularly related straps which improve the article retaining function of the flaps.

DRAWING

Figure 1:
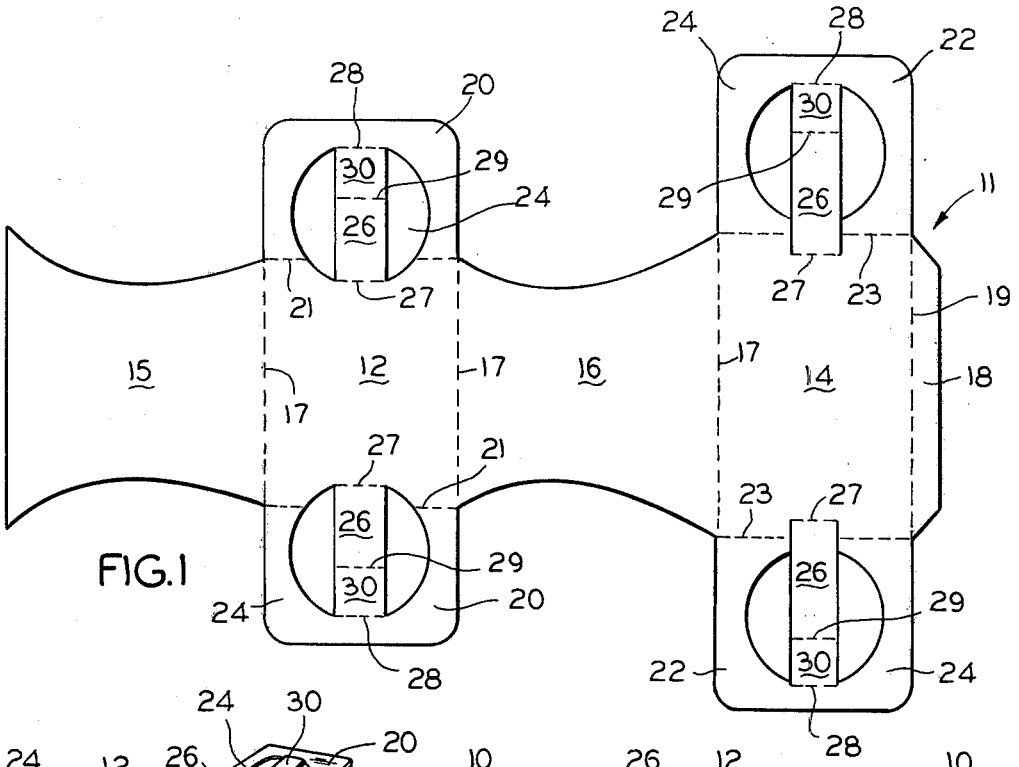
FIG. 1 is a plan view of a paperboard blank scored and cut to form the carrier of the present invention.
Figure 2:
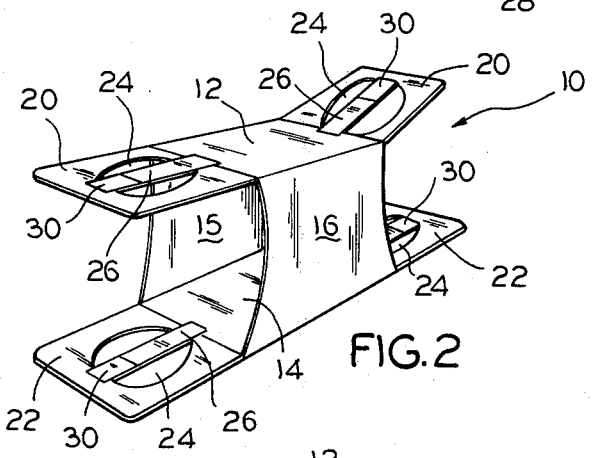
FIG. 2 is a perspective view of the carrier of the present invention in the form of a sleeve open at its ends.

Referring now to the drawing, more particularly FIGS. 2 through 5 there is shown a carrier, generally designated 10, formed from a properly scored and cut paperboard blank 11 illustrated in FIG. 1.

Figure 4:
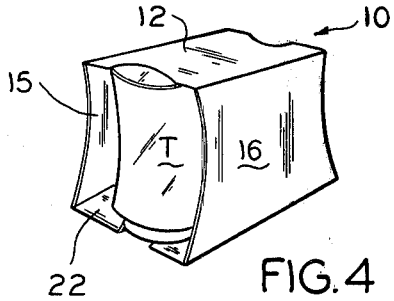
FIG. 4 is a perspective view of a completed carrier.
Figure 5:
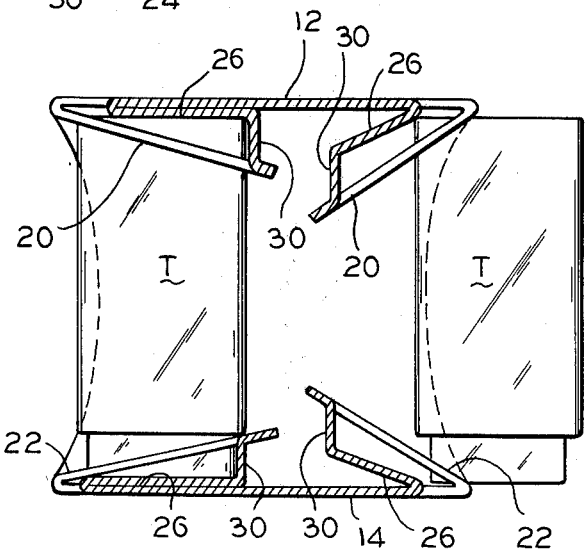
FIG. 5 is a sectional view illustrating the relationship between the locking flaps and the articles within the carrier.

The carrier is especially intended for packaging of cylindrical articles, such as glass tumbers T shown in FIGS. 4 and 5.

The carrier has a top wall 12, a bottom wall 14 and a pair of side walls 15 and 16 hingedly interconnected along fold lines 17. The bottom wall 14 has a glue flap 18 foldably attached thereto along a fold line 19.

The glue flap 19 is adhesively or otherwise secured to a marginal area of the side wall 15 thereby forming a sleeve open at its ends.

Locking flaps 20 are foldably attached to the end edges of the top wall 12 by fold lines 21, while similar locking tabs 22 are hinged to the end edges of the bottom wall 14 along the fold lines 23.

The flaps 20 and 22 have openings 24 formed therein to receive the ends of the articles T.

Figure 3:
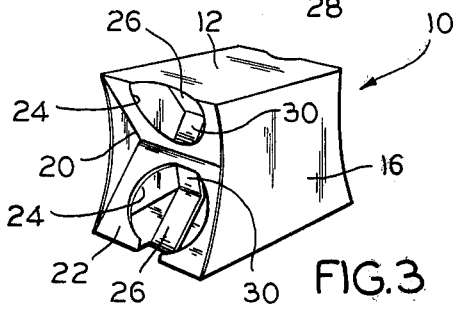
FIG. 3 is a perspective view of the carrier similar to FIG. 2 but showing the sleeve with partially closed ends.

As best seen in FIGS. 3 through 5 each of said locking flaps 20 and 22 is folded inwardly into the carrier toward the wall from which it extends and occupies a plane which is angularly related to said wall.

A strap 26 bridges each of the openings 24 and extends from a terminal fold line 27 to a terminal fold line 28. The line 27 being located in the walls 12 or 14, respectively and being spaced from the respective fold lines 21 or 23. The terminal fold line 28 is positioned in the flaps 20 and 22.

Each of the straps 26 is provided with an intermediate fold line 29 defining a tab 30 and separating it from the remainder of the strap 26.

As best seen in FIG. 5, when the locking flaps 20 and 22 are folded inwardly along the fold lines 21 and 23, respectively, the straps 26 are placed in contacting relationship with the respective walls 12 or 14. The tab 30 is folded at right angles to the remainder of the strap 26 and extends normal to the respective wall 12 or 14.

Article T is received in the opening 24 and retained in the carrier by the locking flaps 20 and 22. The straps 26 and the tabs 30 prevent collapse of the flaps 20 and 22 thus securing the article T within the carrier 10.

We claim:

1. A carrier for at least a pair of cylindrical articles, such as glass tumblers or the like, said carrier being formed from a cut and scored blank of paperboard or the like and comprising:

(a) top, bottom and side walls hingedly interconnected to form a sleeve open at its ends;

(b) locking flaps foldably extending from both end edges of said top and bottom walls and having openings formed therein to receive the ends of said articles;

(c) each of said locking flaps being folded with respect to the wall from which it extends to occupy a plane angularly related to said wall;

(d) a strap bridging each of said openings in said flaps and extending from a first terminal fold line located in each said top and bottom wall to a second terminal fold line located in each respective flap;

(e) each of said straps having an intermediate fold line defining a tab foldable into generally normal relationship with respect to the remainder of said strap;

(f) said remainder of said strap being folded against the inner surface of each respective top and bottom wall with said tab being positioned generally normal to said respective top and bottom wall.

2. A carrier as defined in claim 1, wherein said first terminal fold line is spaced from said locking flap.

3. A carrier as defined in claim 1, wherein said first terminal fold line is spaced from said end edge of said wall.

* * * * *